US011122904B2

(12) United States Patent
Zhang

(10) Patent No.: US 11,122,904 B2
(45) Date of Patent: Sep. 21, 2021

(54) LIGHTWEIGHT FOLDING CHAIR

(71) Applicants: HANGZHOU IN-CHOICE IMPORT AND EXPORT CO., LTD., Zhejiang (CN); Xiangshan Zhang, Zhejiang (CN)

(72) Inventor: Xiangshan Zhang, Zhejiang (CN)

(73) Assignees: HANGZHOU IN-CHOICE IMPORT AND EXPORT CO., LTD., Zhejiang (CN); Xiangshan Zhang, Zhejiang (CN)

( * ) Notice: Subject to any disclaimer, the term of this patent is extended or adjusted under 35 U.S.C. 154(b) by 0 days.

(21) Appl. No.: 16/957,379

(22) PCT Filed: Oct. 24, 2018

(86) PCT No.: PCT/CN2018/111606

§ 371 (c)(1),
(2) Date: Jun. 24, 2020

(87) PCT Pub. No.: WO2020/073360

PCT Pub. Date: Apr. 16, 2020

(65) Prior Publication Data

US 2020/0329875 A1 Oct. 22, 2020

(30) Foreign Application Priority Data

Oct. 13, 2018 (CN) ..... 201821659209.9

(51) Int. Cl.
*A47C 5/10* (2006.01)
*A47C 4/18* (2006.01)
(Continued)

(52) U.S. Cl.
CPC ..... *A47C 5/10* (2013.01); *A47B 91/12* (2013.01); *A47C 4/18* (2013.01); *A47C 4/283* (2013.01); *A47C 4/286* (2013.01)

(58) Field of Classification Search
CPC .. A47C 5/10; A47C 4/18; A47C 4/022; A47C 4/283; A47C 4/286; A47B 91/12
(Continued)

(56) References Cited

U.S. PATENT DOCUMENTS 5,988,755 A * 11/1999 Fastelli ..... A47C 4/022 297/440.1
8,454,084 B2 * 6/2013 Lah ..... A47C 4/02 297/16.2
(Continued)

FOREIGN PATENT DOCUMENTS

CN 102525162 A 7/2012
CN 205093926 U 3/2016
(Continued)

*Primary Examiner* — Robert Canfield

(57) ABSTRACT

The invention discloses a lightweight folding chair, comprising a chair seat and a bottom bracket assembly; the assembly comprises a frame member in the middle that comprises left rear, right rear, left front, and right front connectors, and rear, left, front, and right horizontal tubes that sequentially connect the left rear, right rear, left front, and right front connectors together; a backrest tube is connected to each upper end of the left rear and right rear connectors through the elastic cord; an upper support tube is connected to each upper end of the left front and right front connectors through the elastic cord. The angle of the leg tube is small and the stress is good during use; after the invention is folded, the components are brought close together, the folded volume is smaller, which does not occupy much space and is more convenient to be carried and transported.

8 Claims, 7 Drawing Sheets

(51) Int. Cl.
*A47C 4/28* (2006.01)
*A47B 91/12* (2006.01)

(58) Field of Classification Search
USPC ..... 297/16.2, 45
See application file for complete search history.

(56) References Cited

U.S. PATENT DOCUMENTS

| | | | | |
|---|---|---|---|---|
| 9,066,593 | B2 * | 6/2015 | Homans | A47C 4/03 |
| 9,351,578 | B2 * | 5/2016 | Homans | A47C 4/02 |
| 9,930,966 | B2 * | 4/2018 | Yang | A47C 4/28 |
| 10,285,503 | B2 * | 5/2019 | Graybill | A47C 4/02 |
| 10,653,244 | B2 * | 5/2020 | Yang | A47C 3/025 |

FOREIGN PATENT DOCUMENTS

| | | | | |
|---|---|---|---|---|
| CN | 106562595 | A | 4/2017 | |
| CN | 207152315 | U | 3/2018 | |
| KR | 20170020019 | A | 2/2017 | |
| WO | WO-2016055280 | A1 * | 4/2016 | A47C 4/286 |
| WO | WO2018097494 | A1 | 5/2018 | |

* cited by examiner

LIGHTWEIGHT FOLDING CHAIR

BACKGROUND OF THE INVENTION

1. Field of the Invention

The invention relates to the technical field of chairs, in particular to a lightweight folding chair.

2. Description of the Related Art

The folding chair is a commonly used item in home and is also a stock item when people go out. However, there are some shortcomings in current folding chairs, including: 1. the existing folding chair is folded by linkage mechanism, and folded into a sheet or bundle shape; the folding is not compact enough, the volume is too large, and it is not convenient to be carried; 2. the angle of the leg tube of the existing small folding chair is too large, and the stress is unstable, or the main stressed members are connected by plastic parts, which are relatively soft, thus making the entire chair seat shake too much and the rigidity is poor.

These disadvantages cause the folding chair to be inconvenient to use, greatly reducing the practicality and convenience that the folding chair should have, and greatly reducing the user experience.

SUMMARY OF THE INVENTION

The objective of the invention is to solve the deficiency of the prior art and to provide a lightweight folding chair.

The objective of the invention is realized by the following technical solutions:

a lightweight folding chair, comprising a chair seat and a bottom bracket assembly, wherein the chair seat is connected to the upper end of the bottom bracket assembly;

the bottom bracket assembly comprises a frame member in the middle of the bottom bracket assembly, and the frame member in the middle of the bottom bracket assembly comprises a left rear connector, a right rear connector, a left front connector, a right front connector, and a rear horizontal tube, a left horizontal tube, a front horizontal tube, and a right horizontal tube that sequentially connect the left rear connector, the right rear connector, the left front connector, and the right front connector together; the rear horizontal tube and the front horizontal tube are oppositely arranged; one end of the rear horizontal tube is in pluggable connected to the left rear connector through an elastic cord, and the other end thereof is rotatably connected to the right rear connector through rivets; one end of the front horizontal tube is rotatably connected to the left front connector through rivets, and the other end thereof is in pluggable connected to the right front connector through the elastic cord; the folding of the frame member is realized by the pluggable and rotatable connection of the front horizontal tube, the rear horizontal tube, the right horizontal tube, and the left horizontal tube;

a backrest tube is in pluggable connected to each upper end of the left rear connector and the right rear connector through the elastic cord; an upper support tube is in pluggable connected to each upper end of the left front connector and the right front connector through the elastic cord; a leg tube is in pluggable connected to each lower end of the left rear connector, the right rear connector, the left front connector, and the right front connector through the elastic cord.

Further, both ends of the left horizontal tube are fixedly connected to the left front connector and the left rear connector, respectively; both ends of the right horizontal tube are fixedly connected to the right front connector and the right rear connector, respectively.

Further, any of the backrest tubes comprises a backrest upper tube and a backrest lower tube; the backrest upper tube and the backrest lower tube are in pluggable connected through the elastic cord; the lower end of the backrest lower tube is in pluggable connected to the left rear connector or the right rear connector through the elastic cord; the upper end of the backrest upper tube is in pluggable connected to an elastic cord fixing end plug through the elastic cord.

Further, the upper end of any of the upper support tubes is in pluggable connected to the elastic cord fixing end plug through the elastic cord.

Further, the four ends of the chair seat are respectively connected to the upper ends of the backrest tube or the upper support tube, and the length of the upper support tube is shorter than the length of the backrest tube.

Further, the lower end of any of the leg tubes is in pluggable connected to the elastic cord fixing end plug through the elastic cord.

Further, a foot cover is installed at the lower end of any of the leg tubes.

Further, the folding chair can be folded; first pulling the left horizontal tube and the right horizontal tube outward, then the rear horizontal tube is separated from the left rear connector, and the front horizontal tube is separated from the right front connector; then flipping the right horizontal tube and the rear horizontal tube so that the right horizontal tube and the front horizontal tube are flush, and the rear horizontal tube and the left horizontal tube are flush; next pushing the front horizontal tube and the right horizontal tube to enable the front horizontal tube and the right horizontal tube to rotate, and then the front horizontal tube and the right horizontal tube move close to the rear horizontal tube and the left horizontal tube to achieve a bundle folding; finally pulling out the leg tube, the backrest tube, and the upper support tube in order to bring them close to and parallel to the folded front horizontal tube, right horizontal tube, rear horizontal tube, and left horizontal tube to achieve the final folding.

In summary, by adopting the above technical solutions, the invention has the following advantages compared with the prior art:

The invention is realized to be folded by the method of plug and rotation, and the rear horizontal tube, the left horizontal tube, the front horizontal tube, and the right horizontal tube are arranged in the middle of the chair, which ensures that the angle of the leg tube is small and the stress thereof is good during use, so that the folding chair of the invention can meet high load bearing requirements. After the invention is folded, the components are brought close together, which ensures that the folded volume is smaller; the invention does not occupy too much space and is more convenient to be carried and transported.

BRIEF DESCRIPTION OF THE DRAWINGS

FIG. 4 is a schematic view illustrating the invention after the bottom bracket assembly is completely folded.

In the figures, 1 refers to the left rear connector; 2 refers to the right rear connector; 3 refers to the left front connector; 4 refers to the right front connector; 5 refers to the rear horizontal tube; 6 refers to the left horizontal tube; 7 refers to the front horizontal tube; 8 refers to the right horizontal tube; 9 refers to the elastic cord; 10 refers to the backrest tube; 11 refers to the upper support tube; 12 refers to the leg tube; 13 refers to the chair seat; 14 refers to the elastic cord fixing end plug; 15 refers to the foot cover; 101 refers to the backrest upper tube; 102 refers to the backrest lower tube.

DETAILED DESCRIPTION OF THE PREFERRED EMBODIMENTS

The embodiments of the invention will be further described in detail hereinafter with reference to the drawings.

Figure 1:
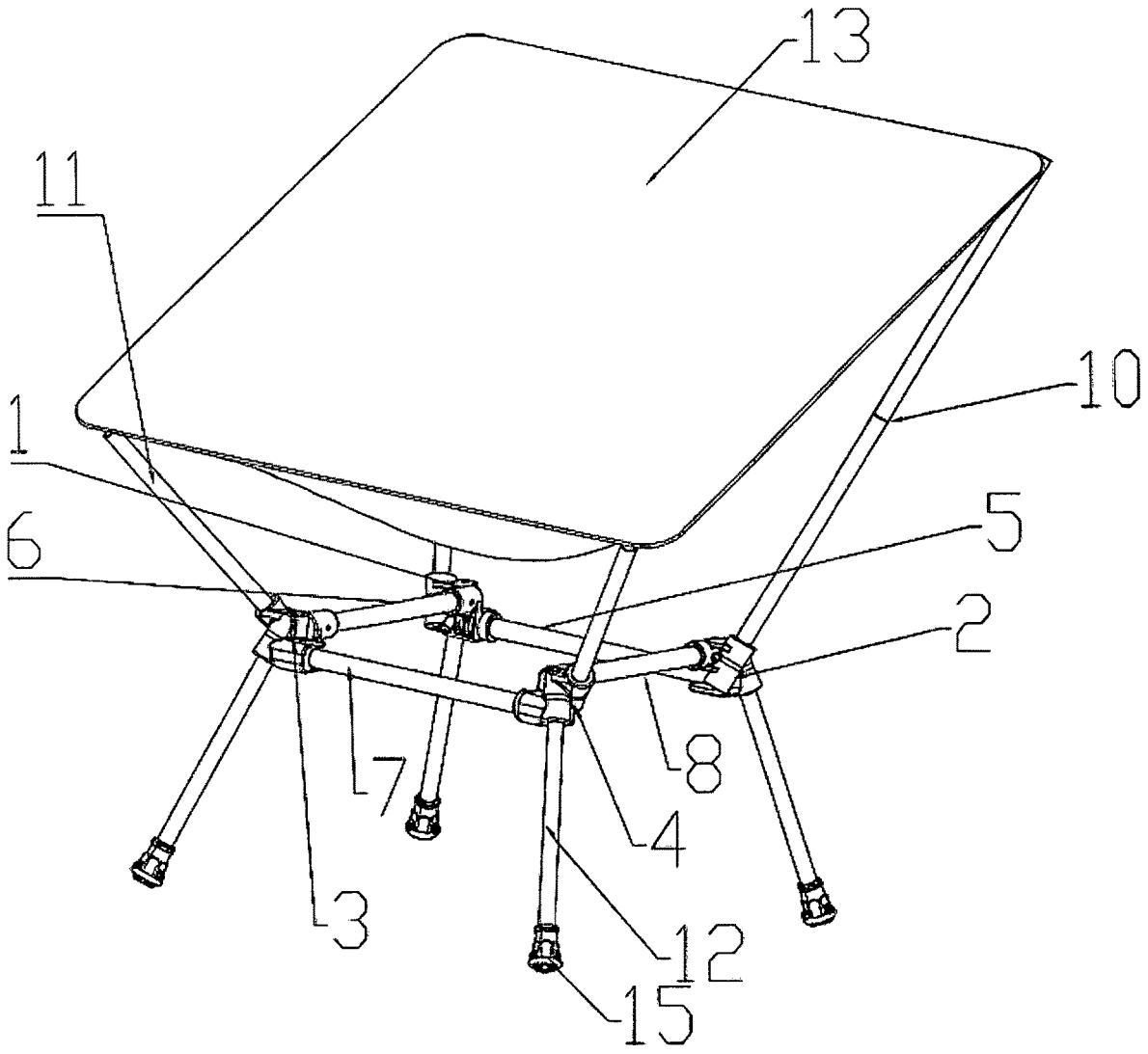
FIG. 1 is a schematic view illustrating the structure of the invention.
Figure 2:
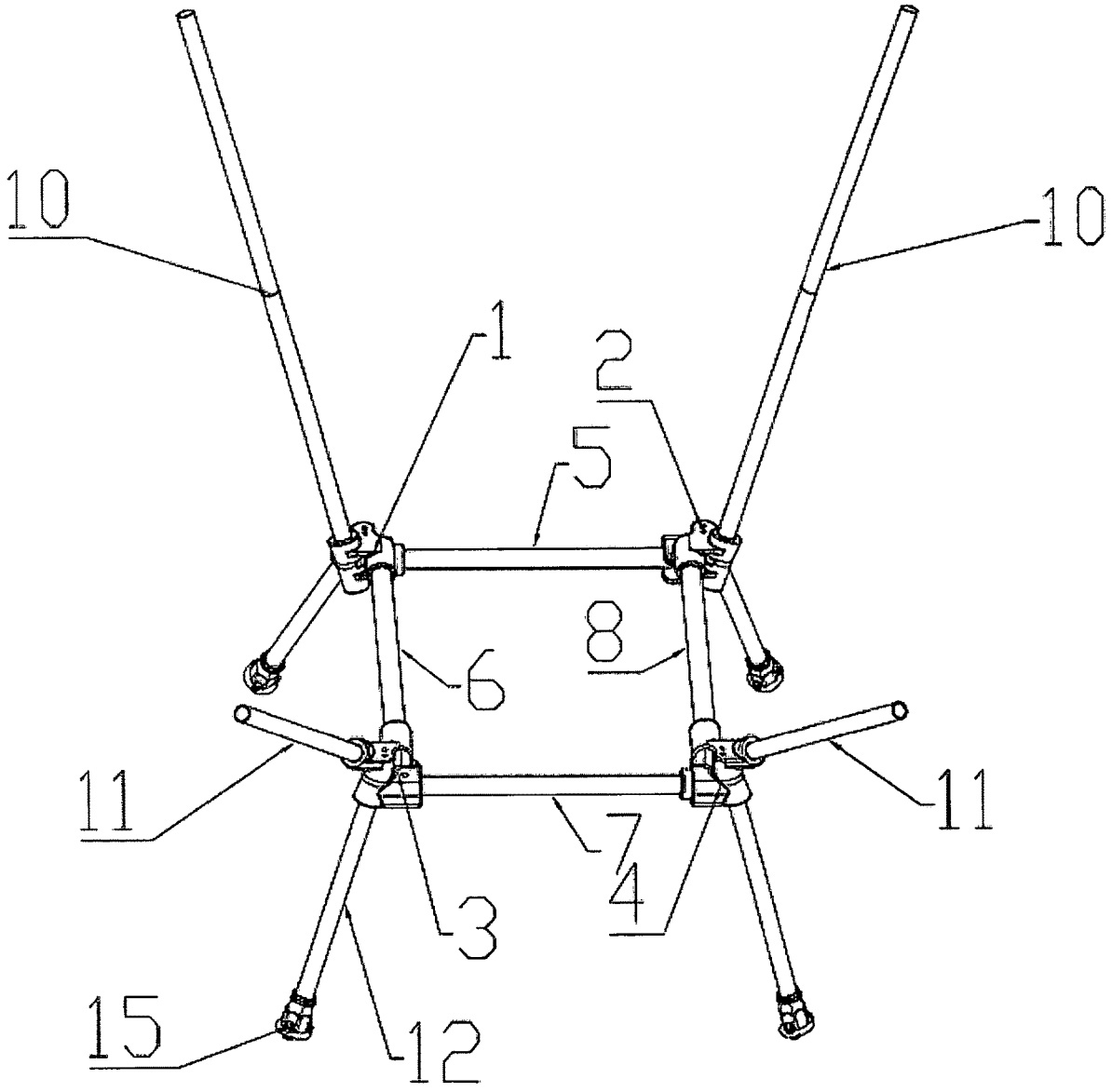
FIG. 2 is a schematic view illustrating the structure of the bottom bracket assembly of the invention.
Figure 3:
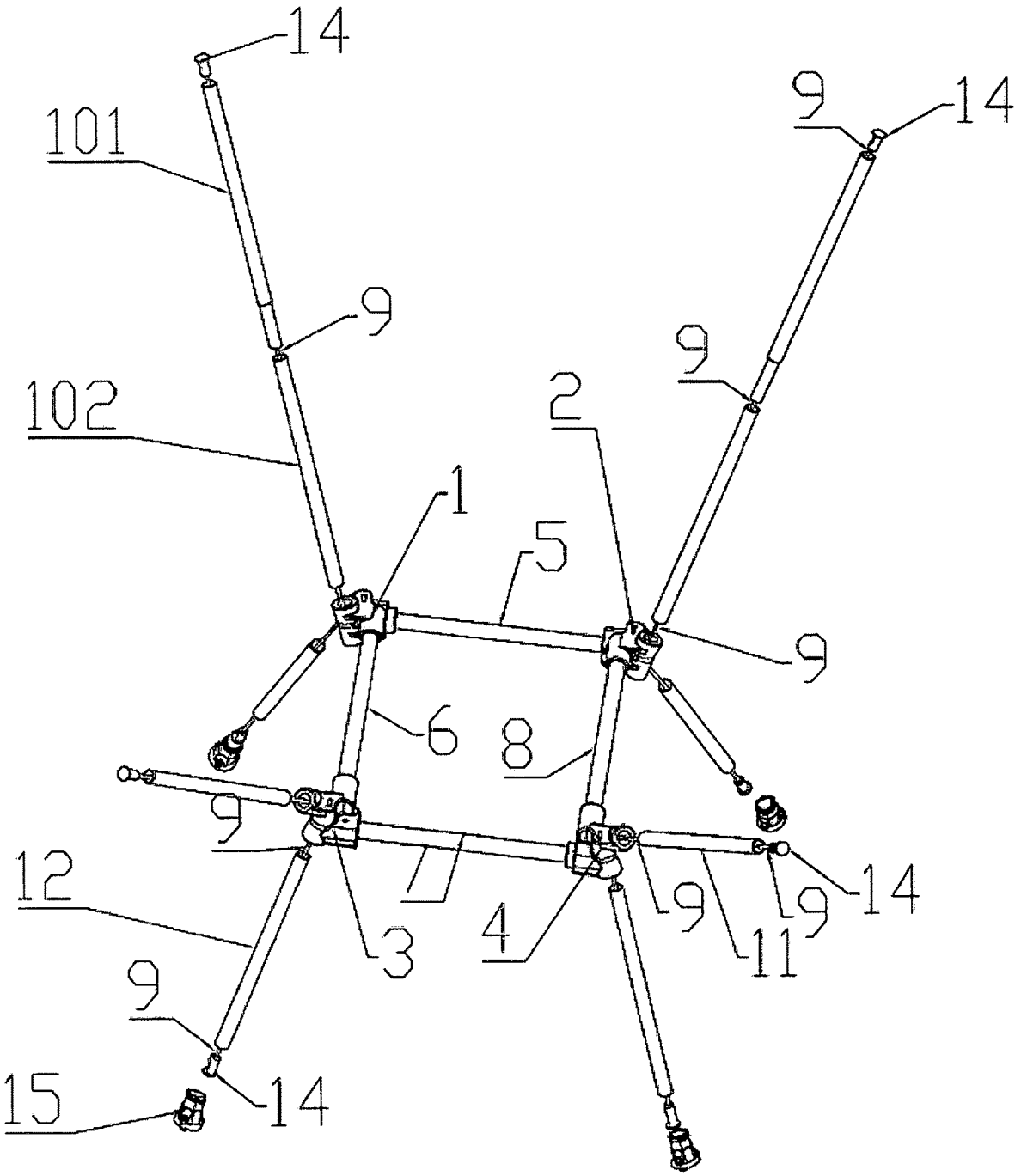
FIG. 3 is a schematic view illustrating the bottom bracket assembly of the invention in a pluggable state.

With reference to FIG. 1-3, the invention provides a lightweight folding chair, comprising a chair seat 13 and a bottom bracket assembly, wherein the chair seat 13 is connected to the upper end of the bottom bracket assembly.

The bottom bracket assembly comprises a frame member in the middle of the bottom bracket assembly, and the frame member in the middle of the bottom bracket assembly comprises a left rear connector 1, a right rear connector 2, a left front connector 3, a right front connector 4, and a rear horizontal tube 5, a left horizontal tube 6, a front horizontal tube 7, and a right horizontal tube 8 that sequentially connect the left rear connector 1, the right rear connector 2, the left front connector 3, and the right front connector 4 together. The rear horizontal tube 5 and the front horizontal tube 7 are oppositely arranged, and the left horizontal tube 6 and the right horizontal tube 8 are oppositely arranged.

Both ends of the left horizontal tube 6 are fixedly connected to the left front connector 3 and the left rear connector 1, respectively; both ends of the right horizontal tube 8 are fixedly connected to the right front connector 4 and the right rear connector 2, respectively. One end of the rear horizontal tube 5 is in pluggable connected to the left rear connector 1 through an elastic cord 9, and the other end thereof is rotatably connected to the right rear connector 2 through rivets. One end of the front horizontal tube 7 is rotatably connected to the left front connector 3 through rivets, and the other end thereof is in pluggable connected to the right front connector 4 through the elastic cord 9.

A backrest tube 10 is in pluggable connected to each upper end of the left rear connector 1 and the right rear connector 2 through the elastic cord 9; an upper support tube 11 is in pluggable connected to each upper end of the left front connector 3 and the right front connector 4 through the elastic cord 9, and the upper end of any of the upper support tubes 11 is in pluggable connected to the elastic cord fixing end plug 14 through the elastic cord 9.

Specifically, the four ends of the chair seat 13 are respectively connected to the upper ends of the backrest tube 10 or the upper support tube 11, and the length of the upper support 11 tube is shorter than the length of the backrest tube 10. There are many connection modes for the chair seat 13 to be connected to the backrest tube 10 or the upper support tube 11: for example, connecting tubes are provided at the four ends of the chair seat 13, the connecting tubes are sleeved on the backrest tube 10 or the upper support tube 11, and then fixed by screws and nuts; or, connecting members are provided at the four ends of the chair seat 13 and connected to the backrest tube 10 or the upper support tube 11 through the connecting members. Different connection modes can be selected according to requirements, and the invention does not limit.

A leg tube 12 is in pluggable connected to each lower end of the left rear connector 1, the right rear connector 2, the left front connector 3, and the right front connector 4 through the elastic cord 9. The lower end of any of the leg tubes 12 is in pluggable connected to the elastic cord fixing end plug 14 through the elastic cord 9; at the same time, a foot cover 15 is installed at the lower end of any of the leg tubes 12, and the elastic cord fixing end plug 14 at the lower end of the leg tube 12 is disposed inside the foot cover 15.

Specifically, any of the backrest tubes 10 comprises a backrest upper tube 101 and a backrest lower tube 102; the backrest upper tube 101 and the backrest lower tube 102 are in pluggable connected through the elastic cord 9. The lower end of the backrest lower tube 102 is in pluggable connected to the left rear connector 1 or the right rear connector 2 through the elastic cord 9; the upper end of the backrest upper tube 101 is in pluggable connected to an elastic cord fixing end plug 14 through the elastic cord 9.

Figure 4:
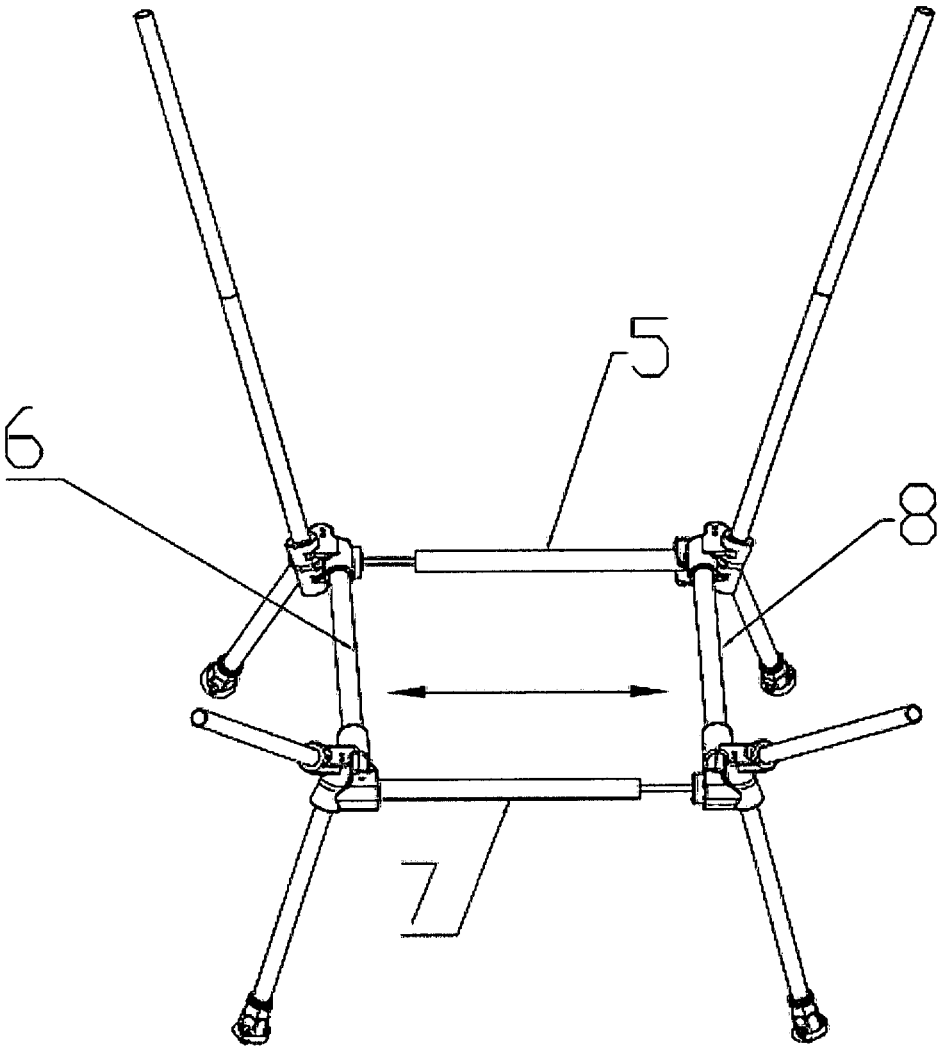
FIG. 4 is a schematic view illustrating the invention when the rear horizontal tube and the front horizontal tube are separated from the left rear connector and the right front connector.
Figure 5:
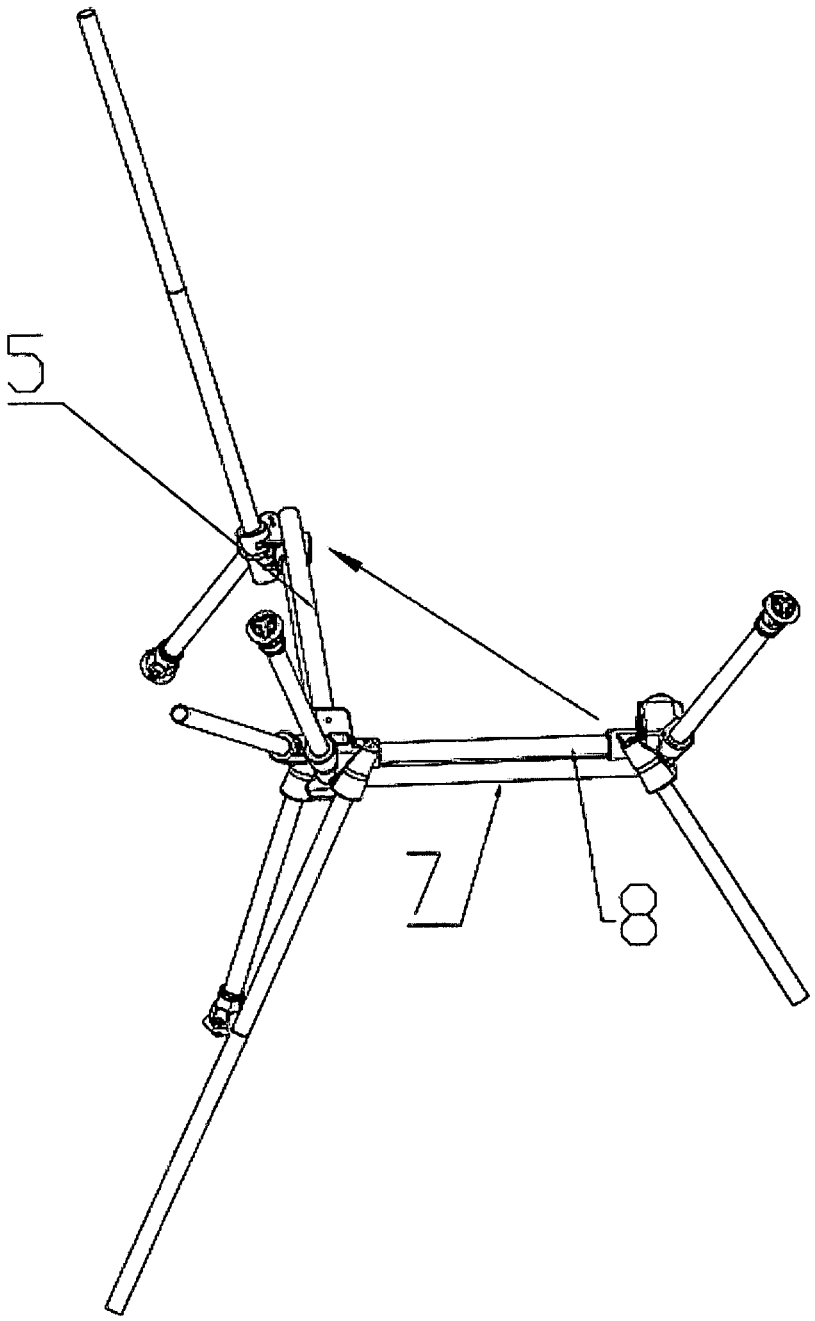
FIG. 5 is a schematic view illustrating the invention in a state after the right horizontal tube and the rear horizontal tube are flipped.
Figure 6:
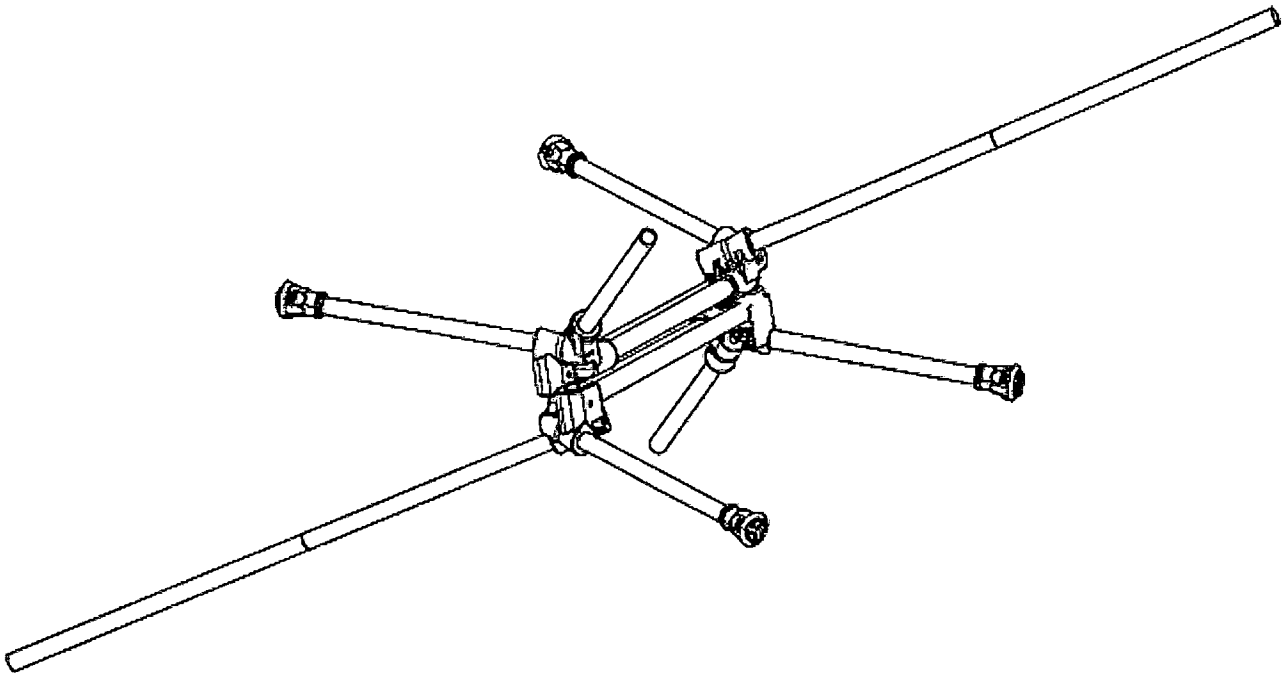
FIG. 6 is a schematic view illustrating the invention in a state after the front horizontal tube and the right horizontal tube are rotated.
Figure 7:
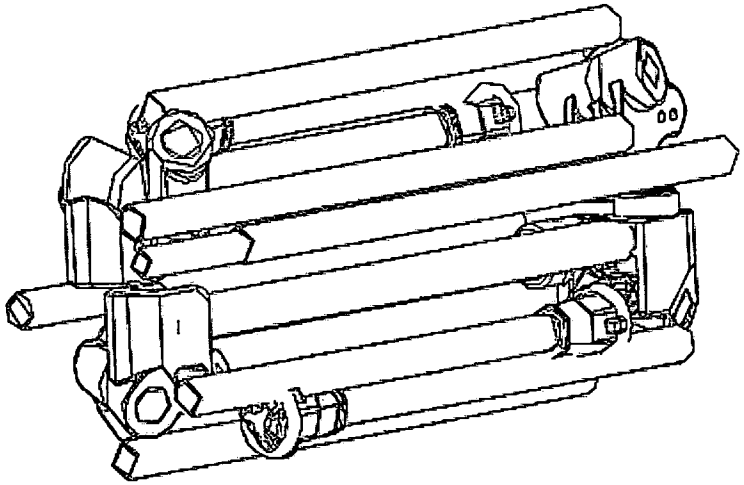

When the bottom bracket assembly of the invention needs to be folded, with reference to FIG. 4, first pulling the left horizontal tube 6 and the right horizontal tube 8 outward in the direction of the arrows in FIG. 4, then the rear horizontal tube 5 is separated from the left rear connector 1, and the front horizontal tube 7 is separated from the right front connector 4. Then flipping the right horizontal tube 8 and the rear horizontal tube 5 so that the right horizontal tube 8 and the front horizontal tube 7 are flush, and the rear horizontal tube 5 and the left horizontal tube 6 are flush, as shown in FIG. 5. Next pushing the front horizontal tube 7 and the right horizontal tube 8 to enable the front horizontal tube 7 and the right horizontal tube 8 to rotate in the direction of the arrow in FIG. 5, and then the front horizontal tube 7 and the right horizontal tube 8 move close to the rear horizontal tube 5 and the left horizontal tube 6 to achieve a relatively compact bundle folding, as shown in FIG. 6. Finally pulling out the leg tube 12, the backrest tube 10, and the upper support tube 11 in order to bring them close to and parallel to the folded front horizontal tube 7, right horizontal tube 8, rear horizontal tube 5, and left horizontal tube 6 to achieve the final folding, as shown in FIG. 7.

In order to improve the strength and stability, the bottom bracket assembly of the invention can be made of high-strength aviation aluminum, which is light in weight and good in rigidity. When not in use, the chair seat 13 can be removed from the bottom bracket assembly. After being folded, the bottom bracket assembly of the invention can be brought together very compactly, which solves the problem that the existing folding chair has a large volume after being folded.

The invention is realized to be folded by the method of plug and rotation, and the rear horizontal tube 5, the left horizontal tube 6, the front horizontal tube 7, and the right horizontal tube 8 are arranged in the middle of the chair, which ensures that the angle of the leg tube 12 is small and the stress thereof is good during use, so that the folding chair of the invention can meet high load bearing requirements. After the invention is folded, the components are brought close together, which ensures that the folded volume is smaller; the invention does not occupy too much space and is more convenient to be carried and transported.

The embodiments described above are only used to explain the technical ideas and characteristics of the invention; the purpose is to enable those skilled in the art to understand and implement the content of the invention, and the protection scope of the invention cannot be limited merely by the embodiments. Any equivalent changes or modifications made according to the spirit disclosed by the invention shall fall within the protection scope of the invention.

The invention claimed is:

1. A lightweight folding chair, comprising a chair seat and a bottom bracket assembly, wherein the chair seat is connected to the upper end of the bottom bracket assembly;

the bottom bracket assembly comprises a frame member in the middle of the bottom bracket assembly, and the frame member in the middle of the bottom bracket assembly comprises a left rear connector, a right rear connector, a left front connector, a right front connector, and a rear horizontal tube, a left horizontal tube, a front horizontal tube, and a right horizontal tube that sequentially connect the left rear connector, the right rear connector, the left front connector, and the right front connector together; the rear horizontal tube and the front horizontal tube are oppositely arranged; one end of the rear horizontal tube is in pluggable connected to the left rear connector through an elastic cord, and the other end thereof is rotatably connected to the right rear connector through rivets; the front horizontal tube is rotatably connected to the left front connector through rivets, and the other end thereof is in pluggable connected to the right front connector through the elastic cord; the folding of the frame member is realized by the pluggable and rotatable connection of the front horizontal tube, the rear horizontal tube, the right horizontal tube, and the left horizontal tube;

a backrest tube is in pluggable connected to each upper end of the left rear connector and the right rear connector through the elastic cord; an upper support tube is in pluggable connected to each upper end of the left front connector and the right front connector through the elastic cord; a leg tube is in pluggable connected to each lower end of the left rear connector, the right rear connector, the left front connector, and the right front connector through the elastic cord.

2. The lightweight folding chair according to claim 1, wherein both ends of the left horizontal tube are fixedly connected to the left front connector and the left rear connector, respectively; both ends of the right horizontal tube are fixedly connected to the right front connector and the right rear connector, respectively.

3. The lightweight folding chair according to claim 1, wherein any of the backrest tubes comprises a backrest upper tube and a backrest lower tube; the backrest upper tube and the backrest lower tube are in pluggable connected through the elastic cord; the lower end of the backrest lower tube is in pluggable connected to the left rear connector or the right rear connector through the elastic cord; the upper end of the backrest upper tube is in pluggable connected to an elastic cord fixing end plug through the elastic cord.

4. The lightweight folding chair according to claim 1, wherein the upper end of any of the upper support tubes is in pluggable connected to the elastic cord fixing end plug through the elastic cord.

5. The lightweight folding chair according to claim 3 or 4, wherein four ends of the chair seat are respectively connected to the upper ends of the backrest tube or the upper support tube, and the length of the upper support tube is shorter than the length of the backrest tube.

6. The lightweight folding chair according to claim 1, wherein the lower end of any of the leg tubes is in pluggable connected to the elastic cord fixing end plug through the elastic cord.

7. The lightweight folding chair according to claim 6, wherein a foot cover is installed at the lower end of any of the leg tubes.

8. The lightweight folding chair according to claim 1, wherein the folding chair can be folded; first pulling the left horizontal tube and the right horizontal tube outward, then the rear horizontal tube is separated from the left rear connector, and the front horizontal tube is separated from the right front connector; then flipping the right horizontal tube and the rear horizontal tube so that the right horizontal tube and the front horizontal tube are flush, and the rear horizontal tube and the left horizontal tube are flush; next pushing the front horizontal tube and the right horizontal tube to enable the front horizontal tube and the right horizontal tube to rotate, and then the front horizontal tube and the right horizontal tube move close to the rear horizontal tube and the left horizontal tube to achieve a bundle folding; finally pulling out the leg tube, the backrest tube, and the upper support tube in order to bring them close to and parallel to the folded front horizontal tube, right horizontal tube, rear horizontal tube, and left horizontal tube to achieve the final folding.

* * * * *